United States Patent [19]

Ohta et al.

[11] Patent Number: 4,465,161

[45] Date of Patent: Aug. 14, 1984

[54] ELEVATOR WINDING DEVICE

[75] Inventors: Kazutoshi Ohta; Sadayuki Ohtomi, both of Aichi, Japan

[73] Assignee: Mitsubishi Denki Kabushiki Kaisha, Tokyo, Japan

[21] Appl. No.: 348,842

[22] Filed: Feb. 16, 1982

[30] Foreign Application Priority Data

Feb. 17, 1981 [JP] Japan ..... 56-21910

[51] Int. Cl.[3] ..... B66B 11/04

[52] U.S. Cl. ..... 187/20; 474/178; 474/190; 254/391

[58] Field of Search ..... 187/20, 21; 474/177, 474/178, 190, 191; 254/391

[56] References Cited

U.S. PATENT DOCUMENTS

| | | | |
|---|---|---|---|
| 1,566,172 | 12/1925 | Stokes | 474/191 |
| 1,576,924 | 3/1926 | Malloy | 474/191 X |
| 2,954,702 | 10/1960 | Petersen | 474/191 X |
| 3,279,762 | 3/1964 | Bruns | 187/20 X |
| 4,013,142 | 3/1977 | Hagg | 187/20 |
| 4,030,569 | 6/1977 | Berkovitz | 187/20 |

OTHER PUBLICATIONS

"Electric Lifts", R. S. Phillips, title page and pp. 64–75.
Advertisement of Otis Elevator Company.

*Primary Examiner*—Joseph J. Rolla
*Attorney, Agent, or Firm*—Bernard, Rothwell & Brown

[57] ABSTRACT

An elevator drive sheave includes a groove in its peripheral surface. A plurality of circumferentially spaced projected teeth are provided in the groove and a lining extends over these teeth. A stranded elevator rope is received in the groove in contact with the lining. The spacing of the teeth is a multiple of the pitch of the strands of the rope. In case of abnormal lining wear, the rope comes in contact with the teeth to insure continued safe tractive force.

5 Claims, 10 Drawing Figures

ELEVATOR WINDING DEVICE

BACKGROUND OF THE INVENTION

The present invention relates to an elevator winding device of the traction type.

Elevator winding devices of the type as described which have been proposed heretofore are those as shown in FIGS. 1 and 2.

That is, in these figures, an output shaft 1 is rotatably supported by means of support means (not shown) on wall surfaces or the like in a building in which an elevator is installed, the output shaft being rotated by a drive energy from a drive source (not shown). A cast-iron drive sheave 2 is secured around said output shaft 1. The drive sheave 2 is formed in its outer peripheral surface with a suitable number of grooves 3. The groove 3 has its bottom formed with a concave portion 3*a*. An annularly molded rubber lining 4 is fitted in said concave portion 3*a* and secured to the groove 3. A main rope 5 of the elevator is stretched over the groove 3*a* of the drive sheave 2 through the lining 4. A transporting cage (not shown) is mounted on one end of the main rope 5 and moved up and down by control of the main rope 5.

That is, a drive energy from the drive source is transmitted to the output shaft 1 to rotate the latter. Then, a rotational output of the output shaft 1 is transmitted to the main rope 5 through the drive sheave 2 and the lining 4. At this time, since the main rope 5 is urged against the lining 4, a relatively great frictional force is produced therebetween. That is, a relatively high tractive force could have been obtained as compared to the case in which the main rope 5 directly comes to contact with the metal groove 3 without the provision of the lining 4.

However, these prior art elevator winding devices have been suffered from significant disadvantages. That is, if the required tractive force is lost due to the deterioration caused by a lapse of age, damages or the like of the lining 4, the main rope 5 is caused to produce a slip relative to the drive sheave 2. As a consequence, there has been inconvenient suffering from troubles in that the operation of the elevator becomes disabled or the elevator falls down.

SUMMARY OF THE INVENTION

It is a primary object of the present invention to provide a useful device which has overcome those disadvantages noted above with respect to prior art elevator winding devices.

It is a further object of the present invention to provide an elevator winding device which can insure safety even if an abnormal condition should occur in a lining of a groove.

It is another object of the present invention to provide an elevator winding device which can obtain an extremely great tractive force when the lining of the groove is in a normal condition.

Other objects and advantages of the present invention will be understood more clearly from the following detailed description of the embodiments illustrated in conjunction with the accompanying drawings.

DETAILED DESCRIPTION OF THE PREFERRED EMBODIMENTS

First, one embodiment of the present invention will now be described with reference to FIGS. 3 through 5.

Figure 1:
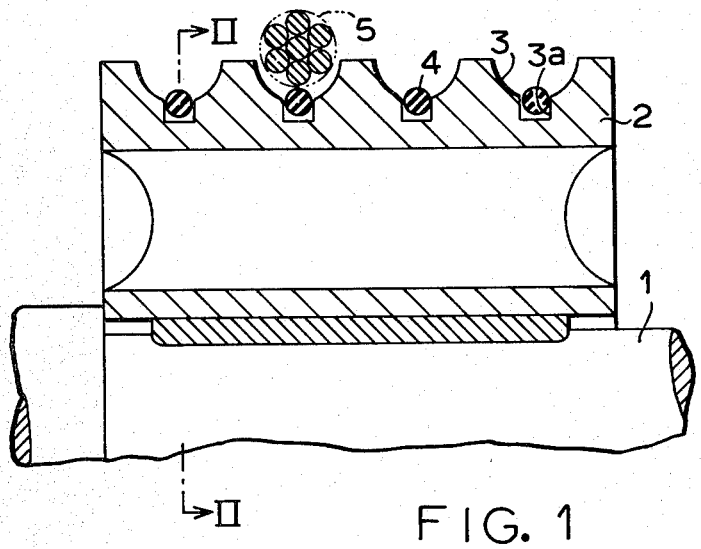
FIG. 1 (PRIOR ART)
FIG. 1 is a longitudinal sectional view showing a principal portion of a conventional elevator winding device.
Figure 2:
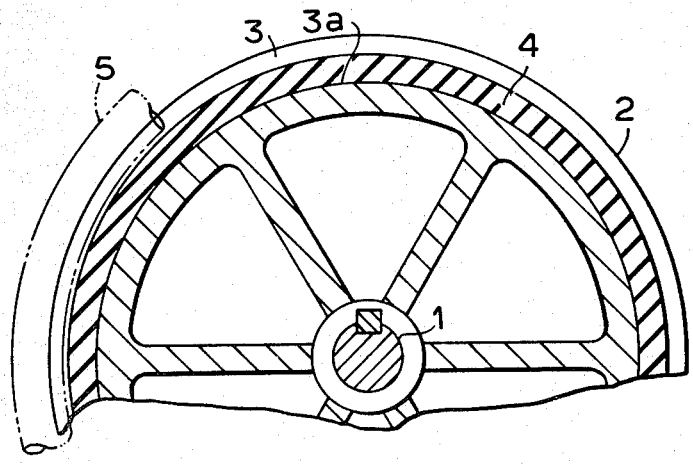
FIG. 2 (PRIOR ART)
FIG. 2 is a sectional view taken along lines II—II of FIG. 1.

In the following drawings, the same reference characters as those used in FIGS. 1 and 2 designate corresponding parts thereof.

A plurality of projected teeth 6 are arranged a predetermined distance from one another in a circumferential direction of a groove 3 of a drive sheave 2. In the figure, reference numeral 5*a* designates strands which constitute a main rope 5, seven strands being used in the illustrated embodiment.

More specifically, a lining 4 is mounted to cover the projected teeth 6 disposed in the groove 3, and the main rope 5 is stretched around the lining 4. Assume that for some reason or other, an abnormal condition occurred in that the lining 4 is displaced. In this case, the main rope 5 is caused to slip because a strand 5*a*, which is in contact with the groove 3, among strands 5*a* constituting the main rope, bridges over the projected tooth 6. At this time, by the action of the projected teeth 6, a tractive force is obtained which is more than two-fold of the tractive force obtained by the metal U-shaped groove 3 and the main rope 5 having no projected teeth as in prior art devices. That is, since a tractive force equal to that obtained when the lining 4 is in a normal condition is provided, it is possible to prevent a trouble of an elevator resulting from the abnormal condition of the lining 4.

Further, an angle through which the main rope 5 is stretched over the drive sheave 2, namely, the angle through which the main rope 5 is in contact with the outer periphery of the drive sheave 2 is generally in excess of 120°. Thus, if more than four projected teeth 6 are provided equally spaced apart in the circumference of the groove 3 of the drive sheave 2, the main rope 5 always comes into contact with at least two projected teeth 6 in the groove 3. As a consequence, it is possible to increase a safety of the elevator when the abnormal condition of the lining 4 should occur.

Next, the basic design of the projected teeth 6 in the winding device of the elevator will be described using dynamic formulae in connection with FIG. 5.

Supposing that:

$\alpha$: angle formed between the uppermost end A of the sheave and the position of a voluntary projected tooth 6, $\beta$: angle formed between the tip angle of the projected tooth 6 and a normal passing through the center of the drive sheave 2, $\Delta T$: difference in tension produced from a difference between the added value of cage's own weight W0 and 125% load W1 of rated load and balanced weight load, W: vertical load applied to a one projected tooth 6, N: number of load points in case that W is distributed at the strand 5*a* pitch, W0: cage's weight, Z: number of main ropes 5, n: number of projected teeth 6 which support vertical load, among those in a circumferential direction, $\mu$: coefficient of friction between the projected tooth 6 and the strand 5*a*, F: component force in a normal direction of contact surface between the projected tooth 6 of $\Delta T$ and the main rope 5, G: frictional force by force F which prevents the strand 5*a* from escaping in the tip direction of the projected tooth 6, H: component of load W in a tangential direction of contact surface between the projected tooth 6 and main rope 5, which serves as a force to prevent the strand 5*a* from escaping in the tip direction of the projected tooth 6, I: force adapted to facilitate the strand 5*a* which tends to escape in the tip direction of the projected tooth 6, R: radius of drive sheave 2, then, $$G=\mu(\Delta T \operatorname{Sin} \beta)$$

$$H=W \operatorname{Cos} (\alpha+\beta)$$

$$I=(\Delta T/n) \operatorname{Cos} \beta$$

$$W_0 \approx 2W_1$$

$$W=\frac{2W_0}{Z \cdot N}$$

$$\Delta T \approx \frac{W_1}{2} \times \frac{1}{Z} = \frac{W_0}{4Z}$$

If G+H−I is equal to Y, $$Y=\left\{\mu \frac{W_0}{4Z} \operatorname{Sin}\beta + \frac{2W_0}{ZN} \operatorname{Cos}(\alpha+\beta)\right\} - \frac{W_0}{4Zn} \operatorname{Cos}\beta \quad (1)$$

$$= \frac{W_0}{4Z}\left\{\mu \operatorname{Sin}\beta + \frac{8}{N} \operatorname{Cos}(\alpha+\beta) - \frac{1}{n} \operatorname{Cos}\beta\right\} > 0$$

In order that the projected tooth 6 is not slid out by the strand 5*a*, the relation of $Y>0$ must be satisfied.

Assume now that the equation (1), constants are set as follows:

$\mu=0.3$ $\beta=30°$ $\alpha=30°$ $N=100$ and when n is obtained to have $Y>0$, then $$0.3 \times \operatorname{Sin} 35° + \frac{8}{100} \operatorname{Cos} 65° - \frac{1}{n} \times \operatorname{Cos} 35° > 0$$

$$02058 > \frac{0.819}{n} \quad n > 3.98 \approx 4$$

Accordingly, in case of the aforesaid assumption, if the drive sheave 2 is provided in its circumference with eight projected teeth 6 or two in two-row half-circumference and thus four in sub-total, and then eight in full circumference, the desired action may be achieved.

Further, since even at the time of abnormal condition of the lining 4, the tractive force similar to that obtained in a normal condition may be obtained, it is possible to reduce a diameter of the drive sheave 2 and to change the main rope 5 from full lap to half lap, thus providing a winding device which is small, simple in construction and economical.

Figure 3:
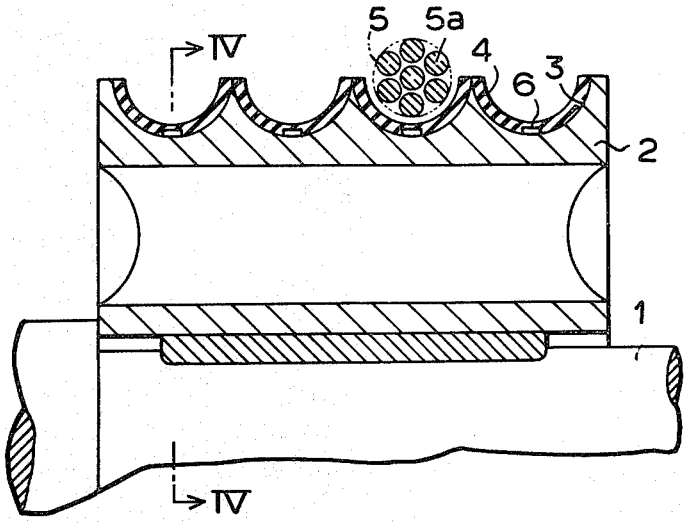
FIG. 3 is a longitudinal sectional view showing a principal portion of one embodiment of an elevator winding device in accordance with the present invention.
Figure 4:
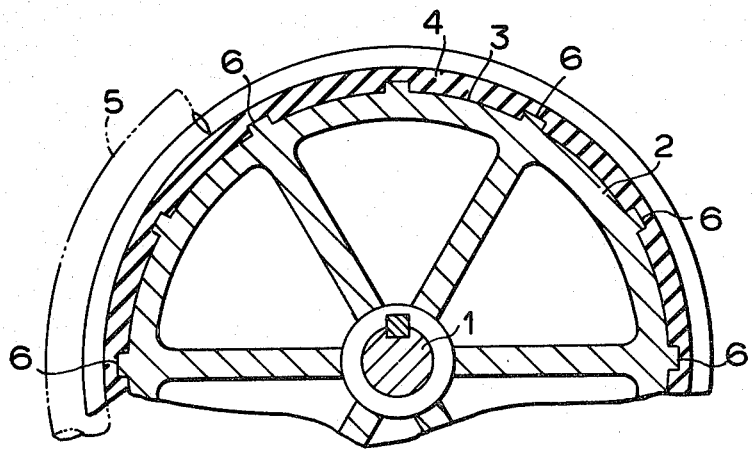
FIG. 4 is a sectional view taken along lines IV—IV of FIG. 3.
Figure 6:
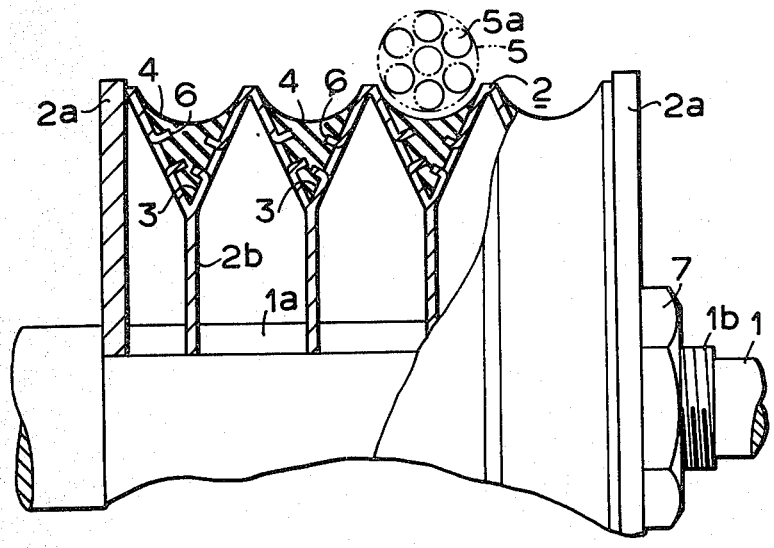
FIG. 6 is a view partly in section of a principal portion showing a further embodiment of the elevator winding device in accordance with the present invention.

FIG. 6 shows a further embodiment of the winding device of the elevator in accordance with the present invention, and in the figure, the same reference characters as those used in FIGS. 3 and 4 designate corresponding parts thereof.

The output shaft 1 has its small diameter portion formed with a spline 1*a*, and has its end formed with threads 1*b*. A side plate 2*a* is provided which is fitted in the spline 1*a* to constitute a part of the drive sheave 2. The body of the drive sheave 2 is composed of a grooved plate 2*b*. That is, the grooved plate 2*b* is formed with a groove 3 in which a peripheral edge portion of a plate material is worked into a V-shape by means of a pulley rolling machine tool. Plural grooved plates 2*b* are fitted in said spline 1*a* and arranged in an overlapping fashion, and arranged between the side plates 2*a*. The side plate 2*a* and the grooved plate 2*b* are urged and fixed by means of a screw 1*b* and a nut 7. Further, the groove 3 is internally formed with projected teeth 6, and a lining 4 is mounted to cover said projected teeth 6.

Figure 5:
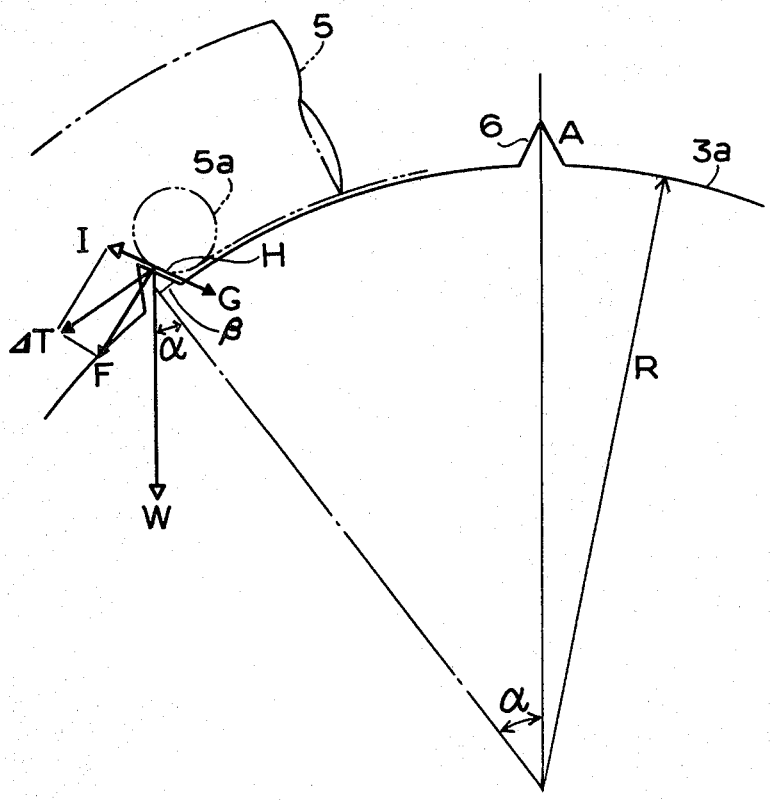
FIG. 5 is a dynamical illustration of the device in FIG. 3.

Accordingly, this embodiment also can achieve the operation and effect similar to those of the embodiment shown in FIGS. 3 to 5.

Figure 7:
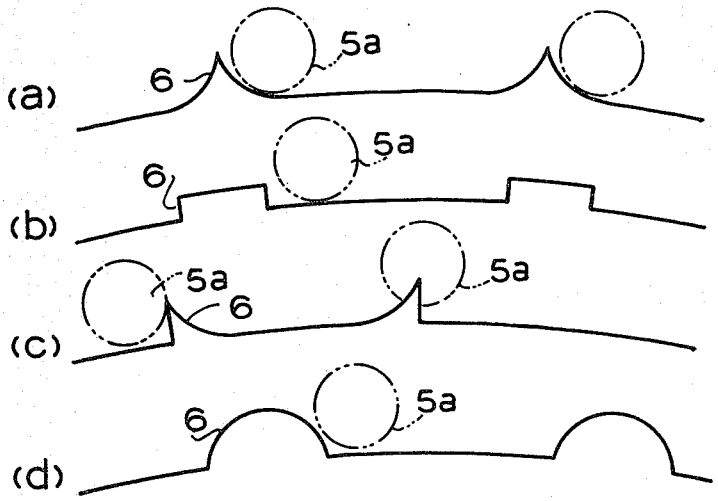
FIGS. 7(*a*)—(*d*) are respectively side views showing modified projected teeth shown in FIGS. 3 and 6.

It should be noted that the shape of the projected teeth 6 in the winding device of the elevator in accordance with the present invention is not limited to those in the previously described embodiments. That is, FIG. 7 illustrates other embodiments of the projected teeth 6 shown in the embodiments of FIGS. 3 to 6. Even the projected teeth having shapes shown in FIGS. 7(*a*) to (*d*) are possible to provide the operation and effect similarly when the lining is in an abnormal condition.

As described above, the present invention provides a winding device of an elevator wherein a plurality of projected teeth are provided spaced apart from each other in a circumferential direction within a metal groove, and a non-metal lining is mounted to cover said projected teeth in an embedded condition. In accordance with the present invention, further, there is provided a device in which the spacing of the projected teeth is provided by a multiple of the pitch of strands of a main rope stretched over the groove. With this, when the lining is in a normal condition, it is possible to obtain a tractive force which is much greater than that obtained by prior art devices. Even in the event that an abnormal condition should occur in the lining, a skid of the main rope can be prevented by engagement of projected teeth with strands. Thus, even in this case, the tractive force equal to that obtained when the lining material is in a normal condition is produced, and therefore, it is possible to provide a highly safe elevator or device which can prevent a trouble in elevator due to the abnormality of the lining. Moreover, it becomes possible to reduce the diameter of the drive sheave and to change the main rope from full lap to half lap, and it can thus offer an effect that a winding device of an elevator which is small and simple in construction may be obtained.

What is claimed is:

1. A winding device of an elevator comprising:

(a) an output shaft rotatably supported, (b) a drive sheave secured around said output shaft and formed with a sheave groove in the periphery thereof, (c) projected teeth provided spaced apart from each other in a circumferential direction of said drive sheave and projecting into said groove, (d) a non-metal lining fastened to said groove to cover said projected teeth, (e) a main rope stretched over said groove while coming to contact with said lining and lifting a cage at one end thereof, (f) said main rope coming to contact with said lining at a stretching angle of more than 120° with respect to said sheave, said projected teeth being at least four which are spaced equidistantly within said groove whereby said main rope is always positioned for engaging at least two of said projected teeth in case of lining wear, and (g) said projected teeth being exposed to engage said main rope when said lining is removed from said groove by wear or abnormal condition whereby the tractive force generated by said groove and said main rope is maintained at a magnitude substantially equal to that obtained when the lining is in its normal condition.

2. A winding device according to claim 1, wherein said main rope is stretched over said sheave in a half-lapping fashion.

3. A winding device according to claim 1, wherein said projected teeth are disposed at a spacing corresponding to a multiple of the pitch of strands of said main rope.

4. A winding device according to claim 1 or 3, wherein said drive sheave has grooved plates which are formed in its peripheral edge portion with grooves and disposed plural in number in an overlapping fashion, and wherein a pair of side plates are disposed on the side of the outermost grooved plates of said grooved plates, said side plates coming into abutment with the outer edge portion of the groove of said outermost grooved plates to hold said plurality of grooved plates in position.

5. A winding device according to claim 4, wherein said side plates constitute side wall surfaces of said sheave.

* * * * *